US006978491B1

(12) United States Patent
Miller

(10) Patent No.: US 6,978,491 B1
(45) Date of Patent: Dec. 27, 2005

(54) INFLATABLE URINAL FOR ATTACHMENT TO A TOILET

(76) Inventor: Roy Miller, 4911 Date St., San Diego, CA (US) 92102

( * ) Notice: Subject to any disclaimer, the term of this patent is extended or adjusted under 35 U.S.C. 154(b) by 193 days.

(21) Appl. No.: 10/776,815

(22) Filed: Feb. 11, 2004

(51) Int. Cl.[7] ..... E03D 9/00
(52) U.S. Cl. ..... 4/300.3; 4/DIG. 5
(58) Field of Search ..... 4/246.2, 300.3, 4/DIG. 5

(56) References Cited

U.S. PATENT DOCUMENTS 3,193,845 A * 7/1965 Funk ..... 4/300.3
4,060,859 A * 12/1977 Anderson ..... 4/DIG. 5
4,979,238 A 12/1990 Clark ..... 4/246.1
5,029,347 A * 7/1991 Lin ..... 4/246.2
5,058,215 A 10/1991 Sims ..... 4/246.1
5,103,506 A 4/1992 Munford ..... 4/246.4

* cited by examiner

*Primary Examiner*—Robert M. Fetsuga
(74) *Attorney, Agent, or Firm*—Goldstein Law Offices, P.C.

(57) ABSTRACT

An inflatable urinal for attachment to a toilet, having a bowl and a seat, for preventing spillage onto the toilet and floor during urination. The urinal includes a plurality of air chambers, held together by seams, which inflate to form an elongated and continuous urinal. The urinal includes a circular support rim attached to one of the air chambers and is used to secure the urinal to the toilet. The circular support includes a plurality of fasteners for coupling with a plurality of mounts attached to the bowl of the toilet. The fasteners of the urinal hold the urinal securely to the mounts of the toilet.

2 Claims, 3 Drawing Sheets

INFLATABLE URINAL FOR ATTACHMENT TO A TOILET

BACKGROUND OF THE INVENTION

The invention relates to an accessory for a toilet seat, and more particularly, to an inflatable urinal for attachment to a toilet, which prevents urine from spraying onto the toilet seat and floor.

The unsanitary nature of the conventional toilet seat has created a need for a means of allowing men to urinate without spillage onto the toilet seat or floor. Women everywhere are constantly nagging at their husbands to clean the toilet seat and floor after urinating. No matter how careful men are when urinating, or how much effort they put into cleaning-up after themselves, the toilet seat and floor area is inevitably dirty and needs to be cleaned often.

U.S. Pat. No. 5,299,328 to Walega discloses a toilet having a stationary bowl and a urinal that is pivotally mounted and capable of retracting. U.S. Pat. No. 2,980,919 to Otto discloses a toilet bowl having a urinal attachment assembly. U.S. Pat. No. 3,412,408 to Michael Jr. discloses a urinal attachment for a toilet.

While these units may be suitable for the particular purpose employed, or for general use, they would not be as suitable for the purposes of the present invention as disclosed hereafter.

SUMMARY OF THE INVENTION

It is an object of the invention to produce a urinal, which attaches to a toilet seat for preventing spillage onto the toilet and floor. Accordingly, the invention is an inflatable urinal that attaches to a toilet and prevents spillage onto the toilet and floor.

It is another object of the invention to provide a retractable urinal. Accordingly, the urinal of the current invention inflates and deflates when a user depresses a foot pump thereby providing a urinal as needed, while still allowing for use of the toilet seat.

The invention is an inflatable urinal for attachment to a toilet, having a bowl and a seat, for preventing spillage onto the toilet and floor during urination. The urinal includes a plurality of air chambers, held together by seams, which inflate to form an elongated and continuous urinal. The urinal includes a circular support rim attached to one of the air chambers and is used to secure the urinal to the toilet. The circular support includes a plurality of fasteners for coupling with a plurality of mounts attached to the bowl of the toilet. The fasteners of the urinal hold the urinal securely to the mounts of the toilet.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
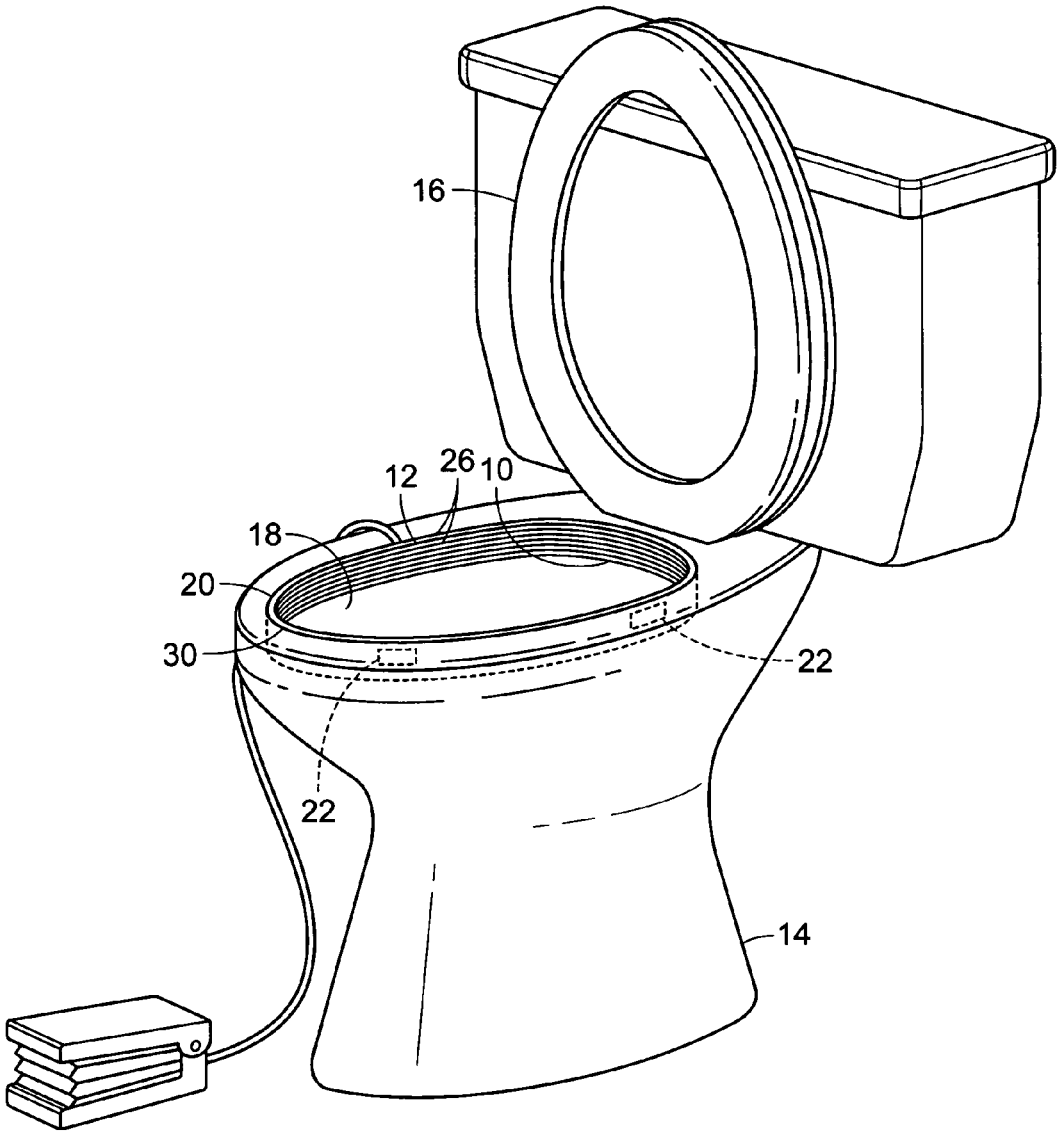
FIG. 1 is a diagrammatic perspective view of the urinal of the present invention shown in a retracted position attached to a toilet.

FIG. 1 illustrates a urinal 10 of the present invention shown in a retracted position 12 attached to a toilet 14. The urinal has a plurality of interlocking air chambers 26 that are adjacent to a circular support 30. The toilet 14 includes a toilet seat 16 and a bowl 18, having an inner rim 20. The inner rim 20 of the bowl 18 of the toilet 14 includes a plurality of hook and loop mounts 22 for securing the urinal 10 to the toilet 14. The hook and loop mounts 22 are fastened to corresponding hook and loop fasteners attached to the urinal 10. The hook and loop mounts 22 hold the urinal 10 in position along the inner rim 20 of the bowl 18 of the toilet 14. The urinal 10 is positioned along the inner rim 20 of the bowl 18 for allowing the toilet seat 16 to lay in either an open position, as shown, or in a closed position flat against the bowl 18 of the toilet 14. This allows a user to sit on the toilet seat 16 without disrupting or affecting the inflatable urinal 10.

Figure 2:
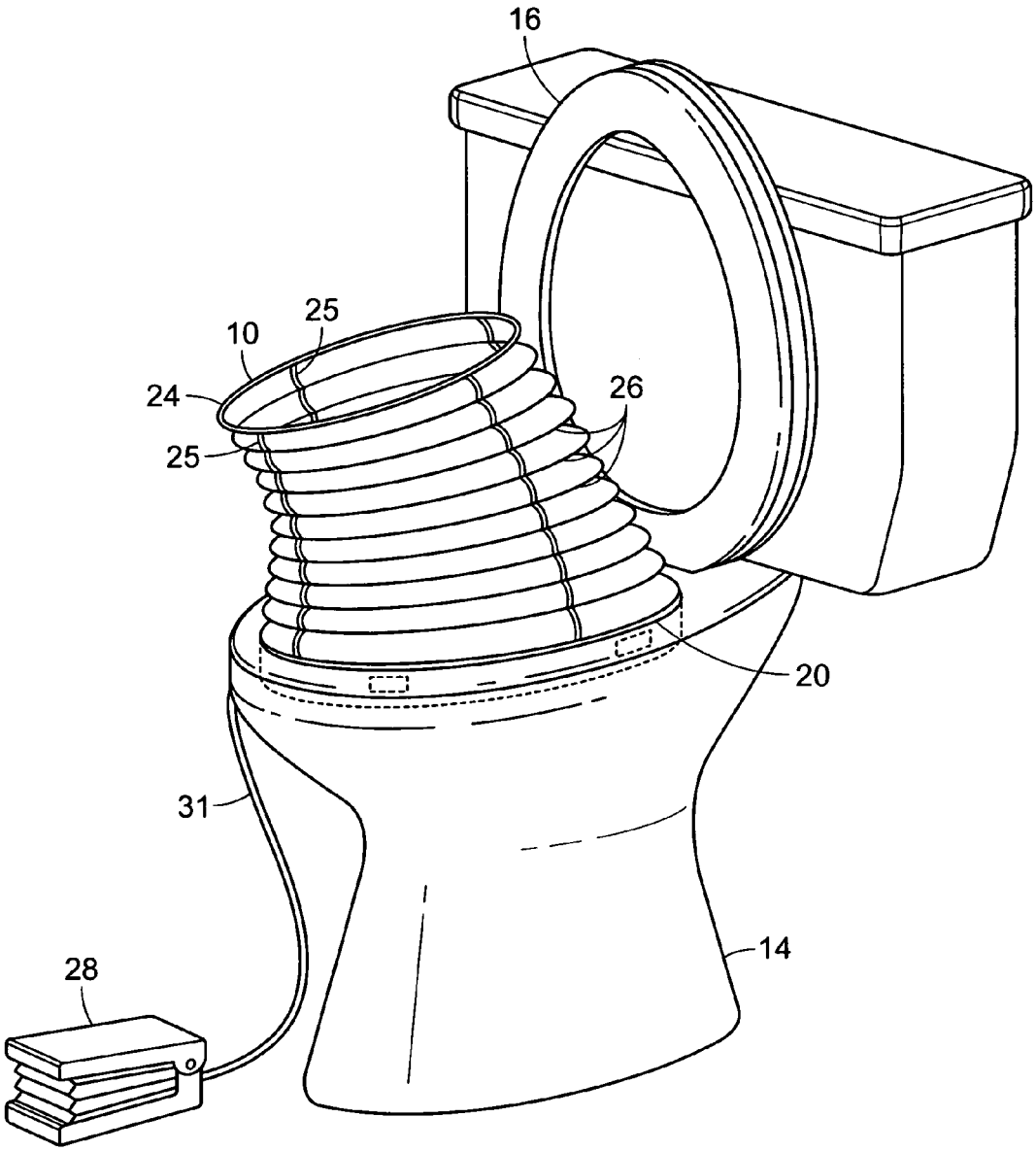
FIG. 2 is a diagrammatic perspective view of the urinal of the present invention shown in the inflatable position before use.

FIG. 2 illustrates the urinal 10 in the inflated position 24 attached to the inner rim 20 of the toilet 14. The air chambers 26 are positioned adjacent to one another for sharing a common interior air terminal, which allows the air chambers to inflate and deflate together as one continuous cavity. When inflated, the air chambers 26 create an elongated inflatable urinal 10, which is banded together by a plurality of seams 25, as shown. The seams 25 allow the air chambers 26 to inflate and deflate, which allows the urinal 10 to fold like an accordion from one position to the other. The urinal 10 in the inflated position prevents spillage onto the toilet and floor.

One of the air chambers 26 is attached to a foot pump 28 by a hose 31. The foot pump 28 includes a two way valve for inflating and deflating the air chambers 26. When a user depresses the foot pump 28, air enters and inflates the air chambers 26, expanding the urinal 10, thereby allowing a user to urinate without causing spillage. When the user is finished, the foot pump 28 is depressed again and the air chambers 26 release the air stored therein, which causes the urinal 10 to deflate into the retracted position 12 as shown in FIG. 1.

In addition, when the toilet seat 16 is in the closed position flat against the bowl 18 and the user depresses the foot pump 28 the air chambers 26 inflate with such force that the toilet seat 16 is automatically pushed upwardly by the air chambers 26 into the open position. This prevents the toilet seat 16 from being in the way of the urinal 10.

Figure 3:
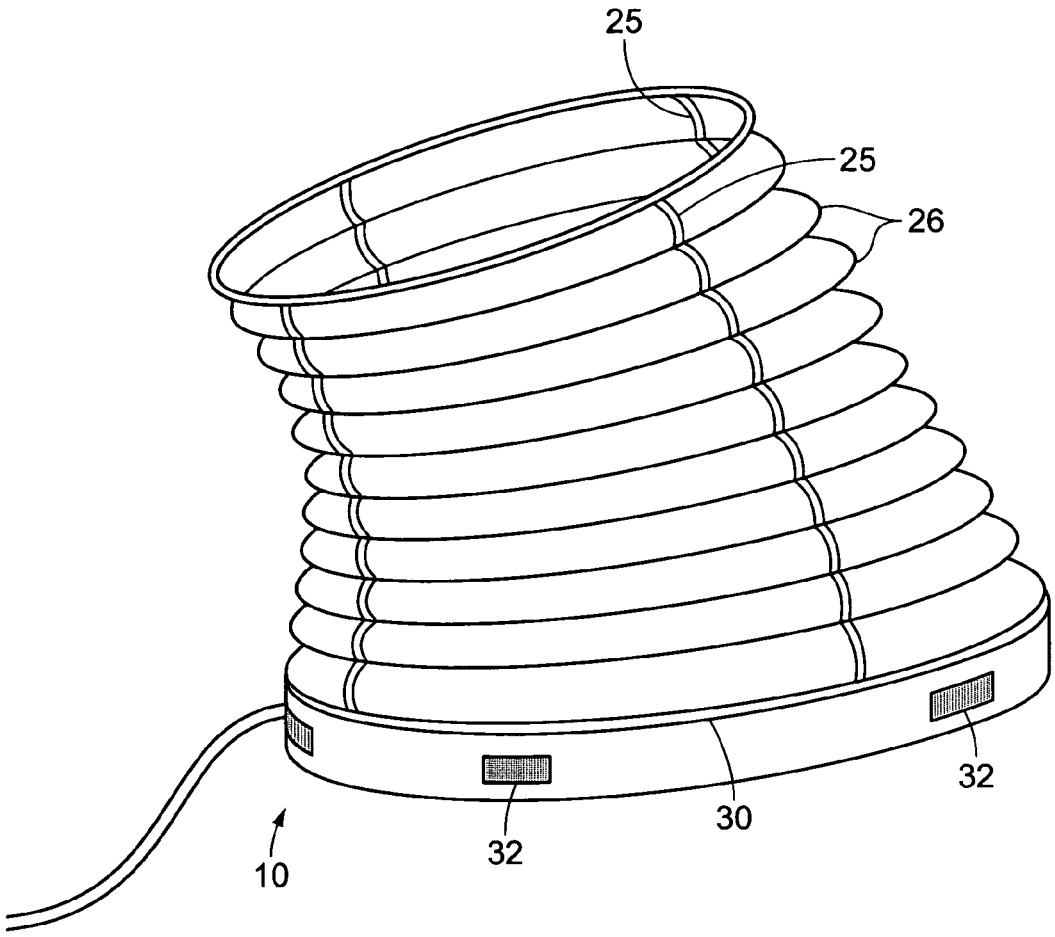
FIG. 3 is an enlarged view of the urinal in the inflatable position, having a plurality of hook and loop fasteners for attaching to the toilet.

FIG. 3 is an enlarged illustration of the urinal 10 and air chambers 26 in an inflated position. The circular support 30 of the urinal 10 is shown having a plurality of hook and loop fasteners 32. The hook and loop fasteners 32 attach to the corresponding hook and loop mounts 22 that are positioned along the inner rim 20 of the bowl 18 of the toilet 14, shown in FIG. 1. The hook and loop fasteners 32 and the hook and loop mounts 22 securely hold the urinal 10 to the bowl 18 of the toilet 14. The seams 25 are shown connecting the air chambers 26 and holding the air chambers 26 in position as the urinal 10 is expanded and retracted.

In conclusion, herein is presented an inflatable urinal for attaching to a toilet. The invention is illustrated by example in the drawing figures, and throughout the written description. It should be understood that numerous variations are possible, while adhering to the inventive concept. Such variations are contemplated as being a part of the present invention.

What is claimed is:

1. A urinal for attaching to a toilet, having a toilet seat, a bowl having an inner rim, having a plurality of hook and loop mounts, the urinal comprising;

a plurality of interlocking air chambers, each air chamber positionable on top of another air chamber for inflating the urinal for use;

a circular support attached to one of the air chambers, having a plurality of hook and loop fasteners for securing the urinal to the hook and loop mounts attached to the inner rim of the bowl of the toilet; and a foot pump attached to one of the air chambers, having a two way valve for inflating and deflating the air chambers when depressed.

2. The urinal of claim 1, wherein the foot pump is depressed by a user to inflate the urinal and raise the toilet seat to an upright position.

* * * * *